US007117620B2

(12) United States Patent
Tolna

(10) Patent No.: US 7,117,620 B2
(45) Date of Patent: Oct. 10, 2006

(54) BANNER MOUNT

(75) Inventor: Stefan N Tolna, Westland, MI (US)

(73) Assignee: Marketing Displays, Inc., Farmington Hills, MI (US)

( * ) Notice: Subject to any disclaimer, the term of this patent is extended or adjusted under 35 U.S.C. 154(b) by 85 days.

(21) Appl. No.: 10/792,460

(22) Filed: Mar. 3, 2004

(65) Prior Publication Data

US 2004/0173724 A1 Sep. 9, 2004

Related U.S. Application Data

(60) Provisional application No. 60/451,459, filed on Mar. 3, 2003.

(51) Int. Cl.
*G09F 17/00* (2006.01)
*G09F 7/00* (2006.01)

(52) U.S. Cl. ..... 40/601; 40/604

(58) Field of Classification Search ..... 40/601, 40/603, 604, 607.01, 611.11; 248/320, 327, 248/328, 332, 495
See application file for complete search history.

(56) References Cited

U.S. PATENT DOCUMENTS

| | | | | |
|---|---|---|---|---|
| 831,973 | A * | 9/1906 | Mudd | 40/525 |
| 1,674,565 | A | 6/1928 | Peterson | |
| 3,673,720 | A * | 7/1972 | Thornton | 40/601 |
| 6,823,619 | B1 * | 11/2004 | Monigle et al. | 40/604 |

* cited by examiner

*Primary Examiner*—Lesley D. Morris
(74) *Attorney, Agent, or Firm*—Harness, Dickey & Pierce, P.L.C.

(57) ABSTRACT

A banner mount for hanging a banner between first and second surfaces is provided. The banner mount utilizes a single rope to couple a banner having a pair of support brackets to the first and second surfaces. Disposed on the first and second surfaces as well as coupled to the brackets are a set of pulleys which, when used in conjunction with the single rope, allow for a centered stable mounting of the banner.

5 Claims, 8 Drawing Sheets

BANNER MOUNT

CROSS-REFERENCE TO RELATED APPLICATIONS

This application claims the benefit of U.S. Provisional Application No. 60/451,459 filed on Mar. 3, 2003. The disclosure of the above application is incorporated herein by reference.

FIELD OF THE INVENTION

The present invention relates to the construction for mounting a banner and, more particularly, to a construction for mounting a banner between a pair of support poles.

BACKGROUND OF THE INVENTION

A banner for displaying advertising or other information usually take the form of an elongated rectangular strip which is secured at its corners, to support poles utilizing cables. Such banners are usually displayed in an outdoor setting, and are subject to wind and other conditions of air turbulence. In order to secure the banners to the poles, individual cables are coupled to each corner of the rectangular banner. As seen FIG. 1, each individual cable is then fixedly coupled by tying to upper and lower locations of the pole. The position of these cables take a significant amount of time. Furthermore, it is often necessary to adjust the lengths of the cables to ensure that the banner is properly located between the support poles.

It is an object of the present invention to provide a banner mounting construction which will reduce the amount of time it takes to raise the banner between the poles. It is further an object of the present invention to provide a construction which will be durable and which will respond well to forces generated by strong winds and other turbulences.

SUMMARY OF THE INVENTION

In accordance with the present invention, there is provided a banner construction for securing to a pair of support poles, the banner having a plurality of mounting locations. The construction has a pair of banner support members each having a pair of fixedly mounted poles and coupling mounting locations. The coupling mounting locations are coupled to the plurality of mounting locations on the banner. A single support cable is threaded through the banner mounting members so as to be in contact with the banner support member. The cable is further fixably coupled at one end to one support pole at a fixed location and is further coupled to the first and second poles utilizing at least one pulley mounting point on each pole.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
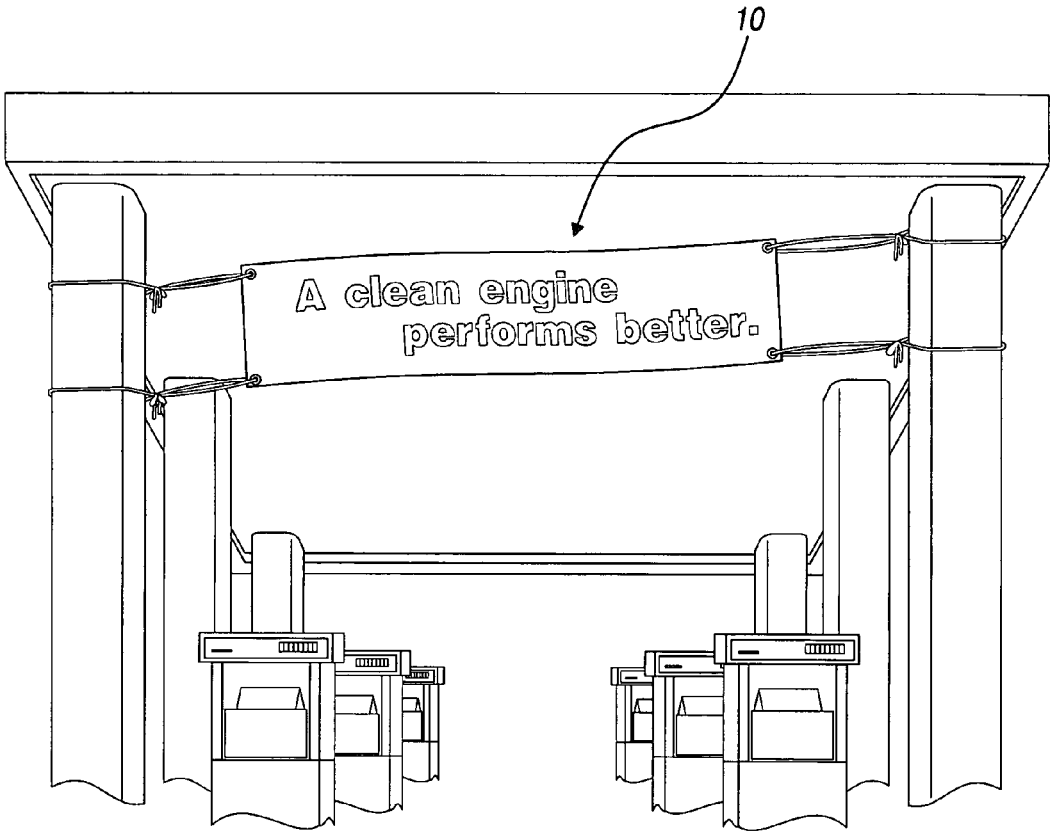
FIG. 1 (PRIOR ART)
FIG. 1 is a banner support system according to the prior art.
Figure 2:
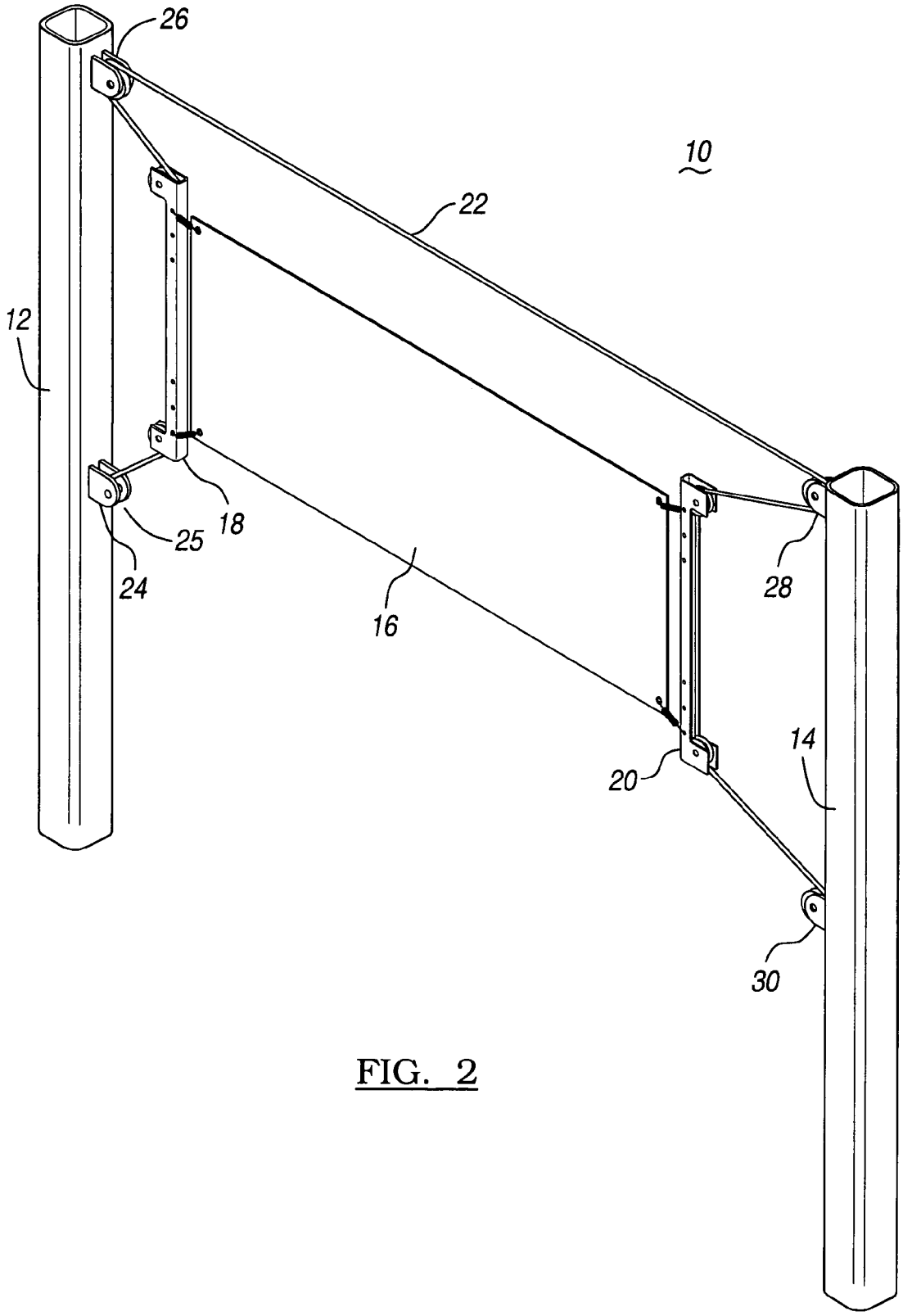
FIG. 2 is a banner support system according to the teachings of the present invention.
Figure 3:
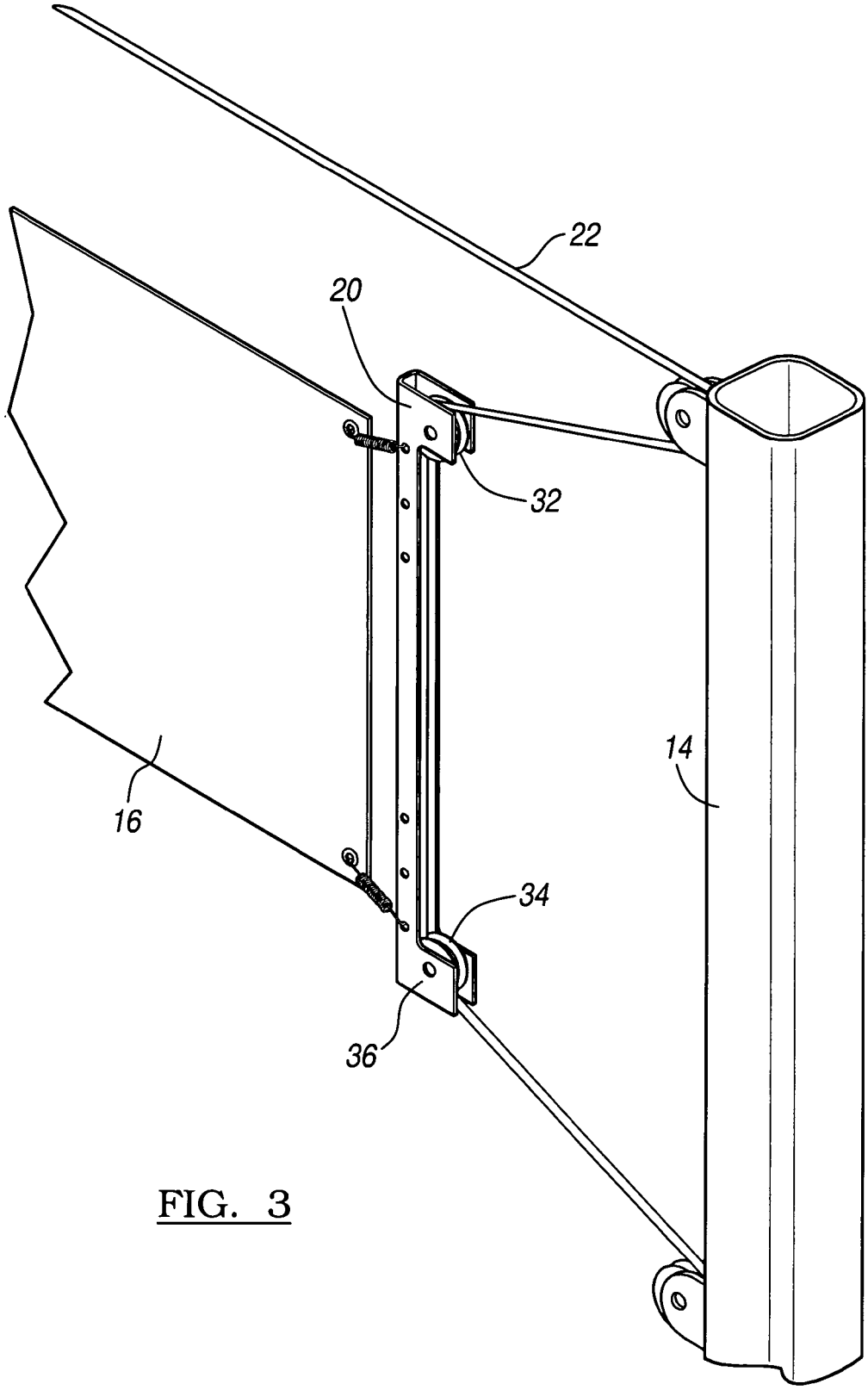
FIG. 3 is a close up of one-half of the banner support system shown in FIG. 1.
Figure 4:
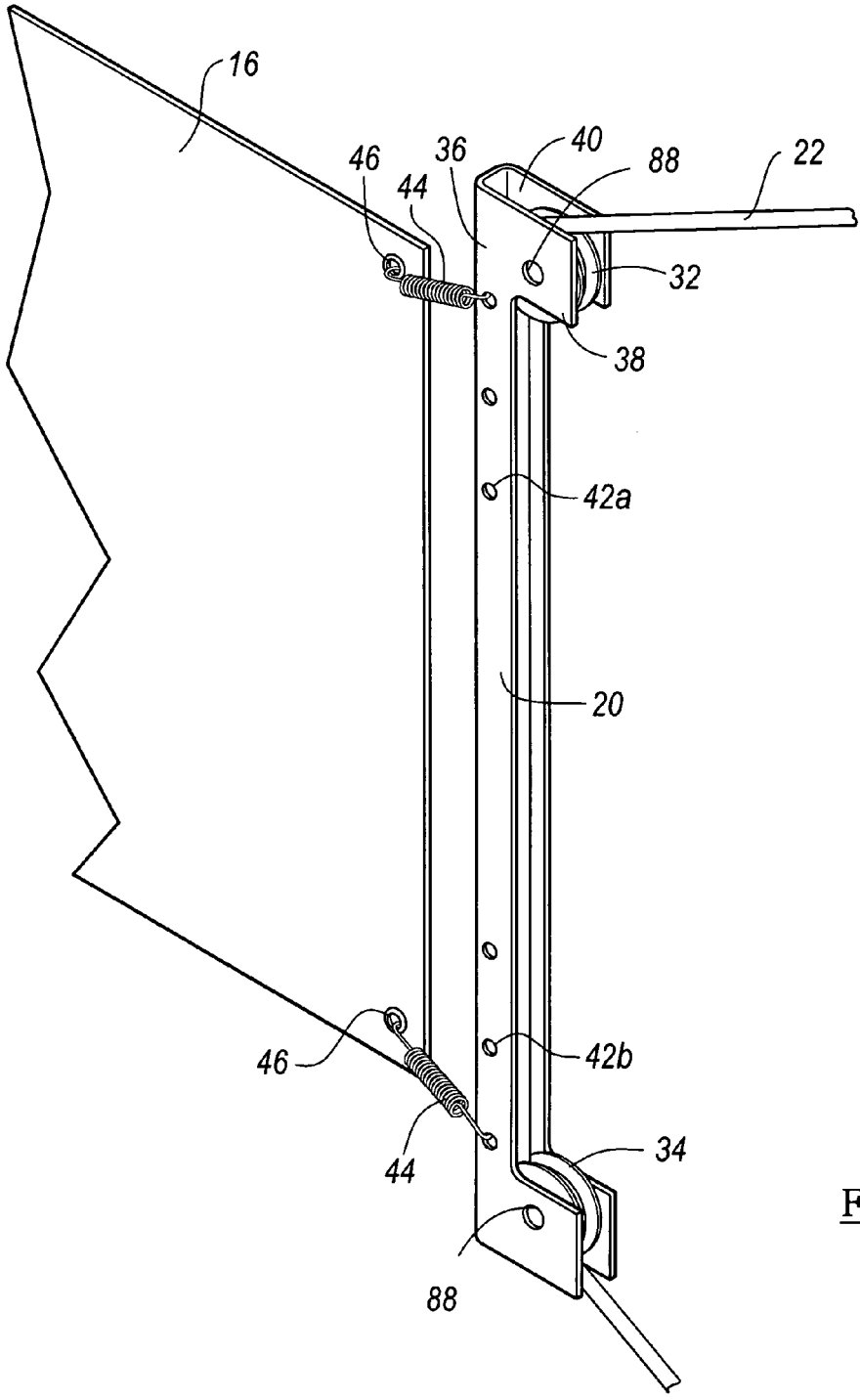
FIG. 4 is a close up of the use of one banner support bracket shown in FIG. 3.

Referring generally to FIGS. 2–4 which depict a banner support mechanism 10 according to the teachings of the present invention, the banner support mechanism 10 utilizes a pair of support poles 12 and 14 to support a banner 16 therebetween. Coupled to opposite ends of the banner 16 are banner support brackets 18 and 20, which function to support the banner utilizing a single flexible member such as a rope or cable 22. The cable 22 is coupled to the first pole 12 at a ground point which is optionally located at a fixed medial support location 24 at a first end 25 of the cable 22. The cable 22 is then threaded through the banner support bracket 18 and threaded through an upper pulley 26 on the first pole 12. The cable then passes above the banner to a second pulley 28 formed on the second pole 14 and again through the second banner supporting bracket 20 to a lower mounting location 30 on the second pole 14. It should be noted that the lower mounting location 30 can take the form of a pulley mount or a bearing surface such as a pin which allows the cable to pass through the lower mounting location 30.

As best seen in FIG. 3, each banner support bracket 18 and 20 has a pair of pulleys 32 and 34 which are configured to apply tension from the cable 22 to the banner 16. The pair of pulleys 32 and 34 allow the rope to be fed in past the lower pulley 34 to the upper-pulley to allow the raising or lowering of the banner 16. While pulleys are shown, it is envisioned that having fixed pins or surfaces with sufficient clearance and surface finish to allow the passing of the flexible member can be used, and is a substitutable equivalent.

FIG. 4 represents a close up of the banner support bracket 20 shown in FIGS. 2 and 3. The bracket 20 is generally formed of a U-shaped member having first and second side walls 38 and 40 and coupled with a pin (not shown). The pulleys 32 and 34 are rotatably disposed between the first and second side walls 38 and 40 and coupled with a pin (not shown). Defined on the first and second side walls 38 and 40 are a plurality of banner mounting locations 42*a* and 42*b*. Disposed between the mounting locations 42*a* and 42*b* and a hole 46 defined in the banner 16 is a coupling member 44. It should be noted that the coupling member 44 can either be stiff or can be elastic. In this regard, the elastic can take the form of a helical spring or, alternatively, can be an elastomer.

Figure 5A:
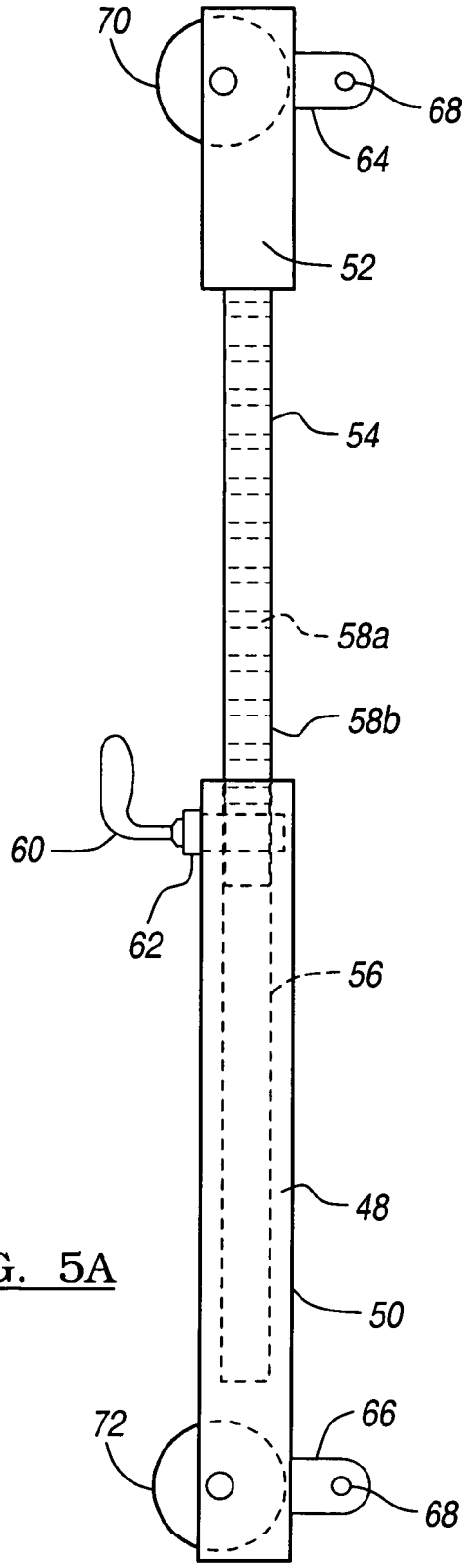
FIGS. 5*a* and 5*b* represent alternate banner support brackets according to the teachings of the present invention.
Figure 5B:
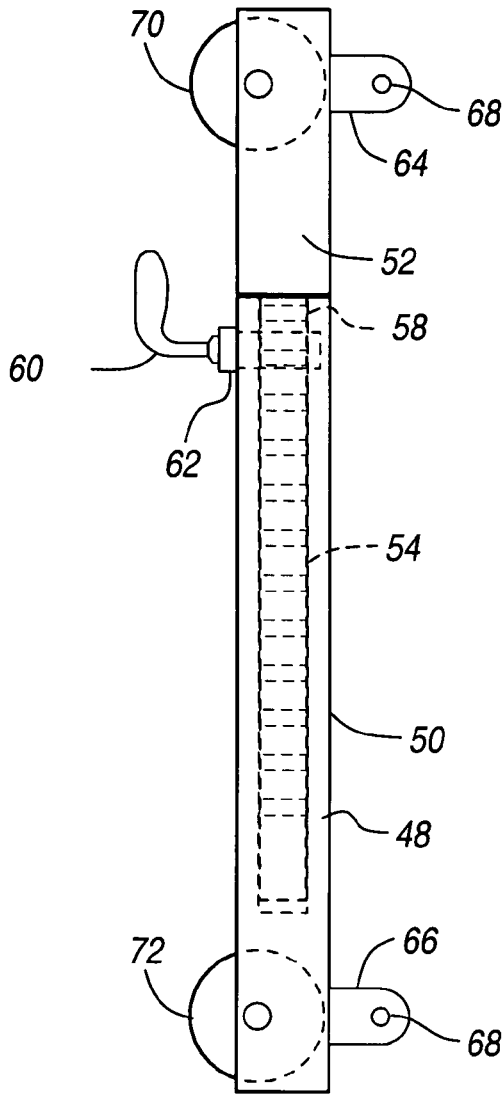

FIGS. 5*a* and 5*b* represent an alternate embodiment of the present invention. FIG. 5*a* depicts a banner support bracket 48 having an upper and lower members 52 and 50. The upper member 52 has a telescopic extension portion 54 which is slidably received within a cavity 56 defined in the lower member 50. The telescopically extending portion 54 defines a plurality of apertures 58*a* and 58*b* which are configured to receive a locking member 62 defined in the lower portion 50. Coupled to the locking member 62 is a handle 60 which can be elastically biased so as to configure the locking pin 62 in its closed position. The banner support bracket 48 further defines an upper and lower mounting structure 64 and 66, which define apertures 68 which are used to couple the banner support bracket to the banner (not shown). Both the upper and lower members 50 and 52 have a pair of pulleys 70 and 72 which are rotatably mounted to the banner support bracket.

As best seen in FIG. 5*b*, the telescopic member 54 can be slid within the cavity 56 to adjust the overall length of the banner support bracket 48. It is envisioned that this will allow adequate sizing of the banner support bracket 48 to accommodate various size banners 16.

Figure 6:
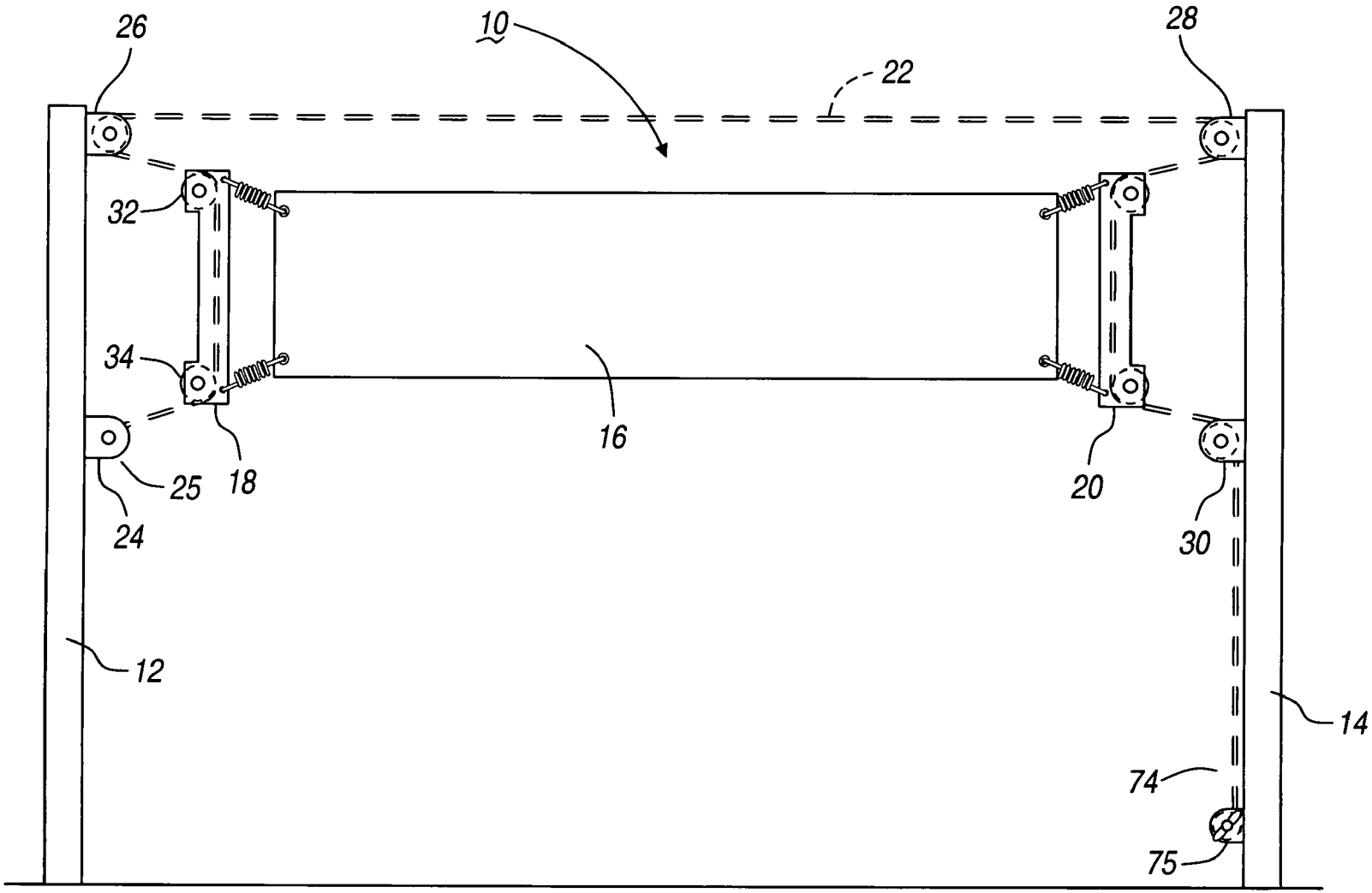
FIG. 6 represents the use of the banner support system shown in FIGS. 2–5.

FIG. 6 depicts the use of the banner support system 10 shown in FIGS. 2–5. As can be seen, a first end 25 of the cable 22 is fixedly coupled to a medial support or ground location 24 of the first pole 12. The cable 22 is then fed past a lower pulley 36 on the first banner support bracket 18 and through the banner support bracket 18 past the upper pulley 32 to the upper mounting location 26. The cable 22 is then fed through the upper mounting location 28 of the second pole 14 and through the second banner support bracket 20 to the lower mounting or ground location 30 of the second pole 14. The cable is pulled to suspend the banner and is fixedly coupled at its second end 74 at a operator accessible tying or ground location 75 of the second pole 14.

In order to lower the banner 16, an operator will release the cable 22 from its coupling at location 75. In releasing the cable 22, cable material travels past the pulleys of the fixed locations and though the banner mounting brackets to allow the banner assembly to be lowered towards ground level. At this time, the banner 16 can be disconnected by disconnecting the coupling members 44 from the banner brackets 18 and 20, and a new banner 16 can be fixed to the banner support assembly. Alternatively, the tension in the cable 22 can be increased such that the banner support brackets 18 and 20 can be pulled adjacent to the first and second support poles 12 and 14 for storage.

Figure 7:
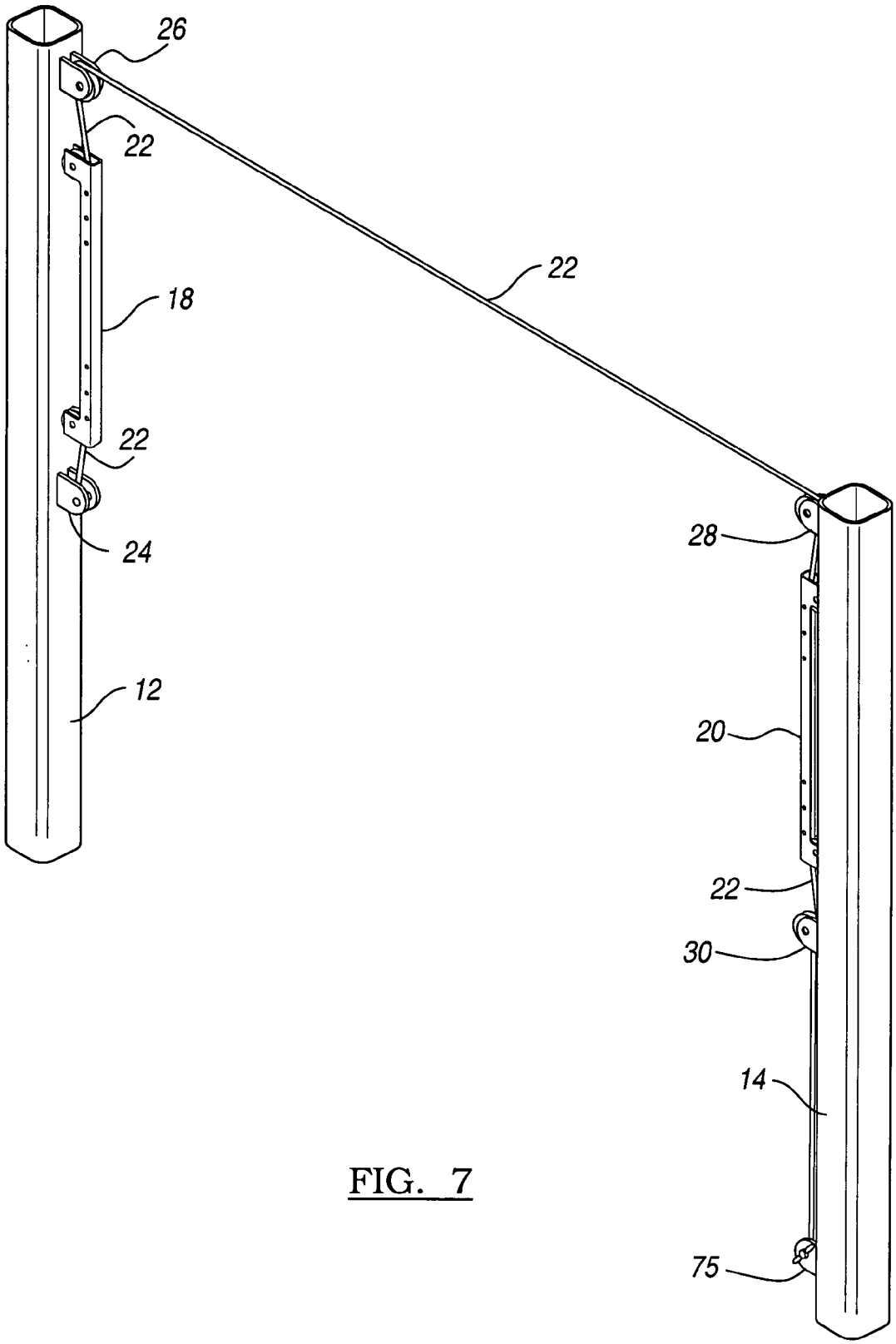
FIG. 7 represents a perspective view of the banner mounting system 10 in its stored position.

FIG. 7 depicts the banner support mechanism in a stored condition. To attach a second banner to the brackets 18 and 22, an operator need only now allow the cable 22 to be fed through the brackets and pulleys to bring the banner support brackets 18 and 20 down to ground level.

Figure 8:
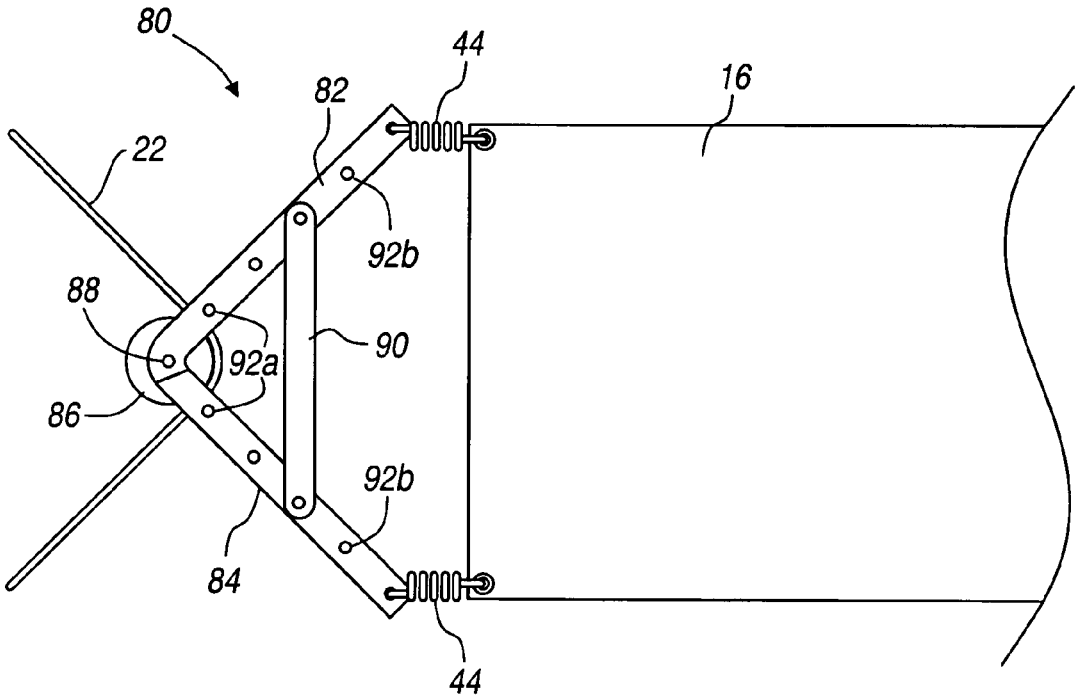
FIG. 8 represents an alternate banner support bracket.

FIG. 8 represents an alternate embodiment of the present invention. FIG. 8 depicts a banner support bracket 80 having first and second bracket members 82 and 84. The first and second bracket members 82 and 84 are pivotally coupled at one end by a pivot pin 88. Disposed about the pivot pin is a pulley 86 which functions to support the banner support bracket 80 using the cable 22 as described above. Disposed between the first and second brackets 82 and 84 is a separator bar 90 which is coupled to a plurality of holes 92 disposed within the first and second bracket members. The spacer bar 90 can be adjusted into any number of holes 92*a*, 92*b* defined within the first and second bracket members 82 and 84 to allow the adjustment of the span of the banner support bracket 80. The banner support bracket 80 is coupled to the banner 16 using coupling members 44 as described above.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A banner mounting system for mounting a banner between a first pole having a first slidable cord accepting location and a second pole having third and fourth slidable cord accepting locations, said system comprising:

a first bracket having a pair of coupling locations, each coupling location comprising a pulley, the first bracket further having a first pair of banner coupling locations, at least one of the pair of coupling locations being configured to slidably accept a suspension cord;

a second bracket having a second coupling location and a second pair of banner coupling locations, said second coupling location being configured to slidably accept the suspension cord;

a single cord disposed through said pair of coupling locations, the second coupling location and said first, third, and fourth cord accepting; and a banner disposed between the first and second brackets.

2. The system according to claim 1 comprising a coupling member disposed between the coupling locations and the banner.

3. The system according to claim 2 wherein the first bracket comprises a U-shaped member.

4. The system according to claim 1 further comprising a second pulley disposed at the second coupling location.

5. The system according to claim 1 wherein the first bracket comprises a pair of telescopically joined members.

* * * * *